United States Patent [19]

Black et al.

[11] 4,303,383

[45] Dec. 1, 1981

[54] CONDITION CONTROL SYSTEM WITH SAFETY FEEDBACK MEANS

[75] Inventors: Robert A. Black, Brooklyn Center; Gary A. Peterson, New Brighton, both of Minn.

[73] Assignee: Honeywell Inc., Minneapolis, Minn.

[21] Appl. No.: 92,829

[22] Filed: Nov. 9, 1979

[51] Int. Cl.[3] ..... F23N 5/00

[52] U.S. Cl. ..... 431/31; 431/46; 307/115

[58] Field of Search ..... 431/46, 6, 24, 31, 59, 431/71, 73; 307/113, 115, 41; 361/64, 66, 77, 81

[56] References Cited

U.S. PATENT DOCUMENTS

| | | | |
|---|---|---|---|
| 3,574,495 | 4/1971 | Landis | 431/31 X |
| 3,727,073 | 4/1973 | Cade | 431/46 X |
| 3,840,322 | 10/1974 | Cade | 431/46 X |
| 3,854,055 | 12/1974 | Sparks | 307/115 |
| 3,854,056 | 12/1974 | Cade | 431/71 X |
| 4,076,487 | 2/1978 | Stoneking | 431/46 X |
| 4,113,419 | 4/1976 | Cade | 431/31 X |

*Primary Examiner*—Samuel Scott
*Assistant Examiner*—Randall L. Green
*Attorney, Agent, or Firm*—Alfred N. Feldman

[57] ABSTRACT

A condition control system in the form of a fuel burner control means is disclosed. A group of relays and their associated contacts are used to control the burner means. The status of the relays and their contacts are continuously checked by a control logic means by having the voltage on key relay output contacts fed into the control logic means through isolated signal transmission means. All of the relays are capable of being deenergized in the event of the need for safety shut down as determined by the control logic means.

18 Claims, 4 Drawing Figures

CONDITION CONTROL SYSTEM WITH SAFETY FEEDBACK MEANS

BACKGROUND OF THE INVENTION

With the advent of solid state control logic means such as microcomputers or microprocessors, a whole new field of control devices has evolved. When these devices are used in condition control or process control applications, the solid state control logic means or microcomputer ultimately controls heavy-duty electrical switching equipment, such as relays. While the microcomputer or microprocessor operations entail possible failure modes that must be guarded against, they also provide an almost unlimited ability to monitor and control related equipment in fail safe manners not previously available in the control art. The ability of the microprocessor or microcomputer to carry out a large number of control functions in an exceedingly short period of time makes this type of a device an ideal tool for monitoring and control of associated equipment.

SUMMARY OF THE INVENTION

The present invention is directed to a safety feedback technique that is particularly applicable to condition control equipment such as burner control devices. It is essential in such devices that certain loads be monitored to insure that they are controlled in a safe manner. For instances, the fuel valve to a burner must be capable of being deenergized or closed in response to either the overall control of the system, or the advent of an unsafe condition within the burner itself or the control equipment. In most condition control applications, and particularly in the burner control art, relays are used as the final control element to energize or deenergize a fuel valve. It is essential that the control of the relay be reliable and/or that some other means of deenergizing the fuel valve be available. In the present invention a unique safety feedback technique has been disclosed which allows for a highly reliable way of operating relays as a final output load controlling means.

The novel system consists of an output contact configuration for the system including contacts that control a critical load, such as a fuel valve. The system further includes means for sensing the status or condition of the critical load contacts. This means is an isolated signal transmission means and can be a device such as an opto-isolator or reed switch. The status of the relay contacts is sensed by such an isolated signal transmission means and a signal is fed back to the control logic means or microcomputer where the information is processed to tell the system whether a safe or unsafe condition exists. If an unsafe condition exists the control logic means or microcomputer is capable of deenergizing all of the relays in the control system or fuel burner. In order to insure that the removal of power from the critical relays in fact deenergizes the critical load, all critical loads are configured with no less than two series connected relay contacts operated by different relays, and the input and output sides of the series connected relay contacts are monitored by the isolated signal transmission means with a feedback to the control logic means. In this way the control logic means can command the relays to open or be deenergized, and simultaneously remove power from all of the relays thereby insuring that at least two sets of relay contacts that are in series with a critical load are deenergized and opened.

DESCRIPTION OF THE PREFERRED EMBODIMENT

Figure 1:
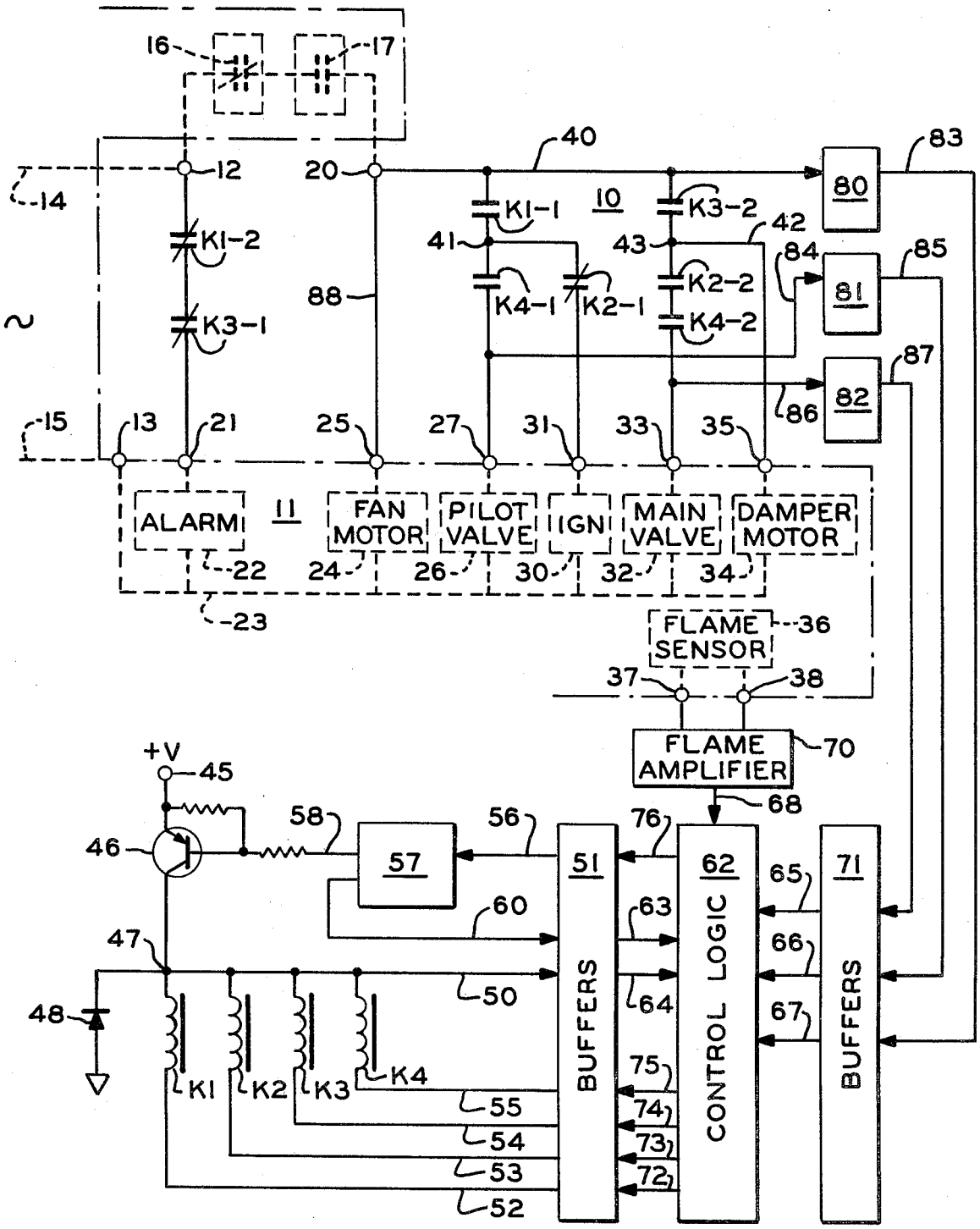
FIG. 1 is a schematic representation of a burner control system utilizing four relays to safely control all of the functions of the burner connected to the burner control device.

A condition control system is generally disclosed at 10. The condition control system specifically disclosed is a system for controlling a fuel burner which has been generally disclosed at 11. While the condition control system 10 can be used to operate many types of systems, the present disclosure will be specifically directed to the application of the control system to the fuel burner 11 and the description will be tailored to that type of device.

Before describing the condition control system in detail the fuel burner 11 will be generally described. The system utilizes a number of terminals including terminals 12 and 13 to which the conventional source of alternating current potential is applied via conductors 14 and 15. Terminal 12 is adapted to be further connected to a limit switch means 16 that senses the availability of fuel, and other safety limits for a conventional fuel burner. The limit switch means 16 is connected to an operating control 17 such as a switch or thermostat. The operating control 17 is connected to a further terminal 20 through which the conductor 14 applies power to the condition control system 10 when the limit control means 16 and the operating control 17 are closed.

The conductor 15 is connected via the terminal 13 to a series of load means for the fuel burner means generally disclosed at 11. At a terminal 21 an alarm 22 is connected to a common conductor 23 that is connected to the terminal 13. The alarm 22 indicates when a failure of the control system 10 has occurred. The conductor 23 is further connected to a fan motor 24 that in turn is connected to a terminal 25. The fan motor 24 supplies air under pressure to the fuel burner means generally disclosed at 11 and forms part of the load means for the device. The conductor 23 is next connected to a pilot valve 26 which is connected by terminal 27 to the condition control system 10. The pilot valve supplies fuel to a pilot burner for the disclosed fuel burner means. The conductor 23 is next connected to an ignition source 30 that is connected to a terminal 31. The ignition source 30 can be a conventional ignition transformer or could be a solid state ignition device of a type which is now becoming commonly available in the fuel burner market. The next element of the fuel burner means 11 is a main fuel valve 32 that is connected to a terminal 33. The main fuel valve 32 is considered the most critical load connected to the control system 10 and reliable operation of power to the main valve 32 is essential. The pilot valve 26 also can be considered as a critical load in some installations and will be dealt with as such in the present disclosure. The safety of operation of both the pilot valve 26 and the main valve 32 will be detailed as part of the present invention.

The next part of the load means for the fuel burner means 11 is a damper motor disclosed at 34 connected to a terminal 35. The damper motor and an associated damper is a common element in many fuel burner installations, but is not essential to all types of fuel burner installations. In order to provide a complete disclosure of the system, the system has been disclosed as one which includes a damper motor which drives a damper between a low fire and a high fire position for prepurge of the burner, and the proper ignition and burning of fuel supplied under the control of the condition control system 10.

The fuel burner means 11 is completed with a flame sensor 36 which is connected by a pair of terminals 37 and 38 to the condition control system 10. The elements of the fuel burner means that have been disclosed make up the elements of most conventional fuel burning installations and are typically adapted to be connected to the condition control system 10 for operation thereby. The fuel burner means 11 is designed to be operated by the operation of four relays K1, K2, K3, and K4 which are the output relays of the condition control system 10. The relays K1, K2, K3 and K4 have been selected to operate a group of contacts that have been identified as K1-1, K1-2, K2-1, K2-2, K3-1, K3-2, K4-1, and K4-2. The function and location of these individual relay contacts will be further identified and explained.

The relay contacts K1-2 and K3-1 are a pair of normally closed relay contacts associated with the relays K1 and K3 and are connected in series between the terminals 12 and 21 to supply power to the alarm 22 in the event that the relays K1 and K3 are simultaneously deenergized during the operation of the condition control system 10. The relay contacts K1-1 and K4-1 are connected in a series circuit between a conductor 40 (which is connected to terminal 20) and the terminal 27 which in turn is connected to the pilot valve 26. The relay contacts K1-1 and K4-1 are normally open contacts and form a series circuit wherein a pair of contacts from at least two relays are connected in a series energizing circuit for the pilot valve 26 which can be considered as a critical load for the present device.

The relay contact K2-1 is connected from a common point 41 between the relay contacts K1-1 and K4-1 to the terminal 31 which supplies power to the ignition source 30 during the operation of the condition control system 10. The relay contacts K3-2, K2-2, and K4-2 are connected to form a series circuit between the conductor 40 and the terminal 33 which supplies power to the main valve 32. The main valve, as has been previously mentioned, is obviously a critical load in a fuel burner installation and in this particular arrangement has three different relay contacts in series circuit between the energizing conductor 40 and the terminal 33. It is quite obvious that if any of the three contacts K3-2, K2-2, or K4-2 open, that the main valve 32 will be deenergized.

The last energizing circuit through the relay contacts is provided by a conductor 42 which is connected at 43 between the relay contacts K3-2 and K2-2 and is a means of supplying power to the terminal 35 to the damper motor 34 when the damper motor is to be operated. It will be noted that the damper motor 34 is operated in response to one of the existing relays and does not require a further relay in the condition control system 10.

The number of relays and the configuration of the relay contacts are dictated by the requirement that at least two pairs of the relay contacts are provided in a series electrical circuit to each of the critical loads disclosed as the pilot valve 26 and the main valve 32. In order to minimize the number of relays that are used in the system to obtain the specified relay safety configuration, a system for deriving the output contact configuration is accomplished by the use of a standard Karnaugh logic map technique. The Karnaugh logic map technique is a logic technique that is known in the arts and is capable of determining the minimum number of logic elements to perform a particular function. The use of a standard Karnaugh logic map technique was used to derive the fact that the system could operate with a minimum of four relays utilizing a relay contact configuration as disclosed in FIG. 1. The use of a Karnaugh logic map technique is not essential to the present invention, but is one tool to provide for minimizing the number of components utilized. The only essential element in determining the number of relays and relay contacts is that at least two pairs of relay contacts are utilized in a series circuit with any load which is considered to be a critical load.

The relays K1, K2, K3, and K4 are all energized from a common voltage source 45 through a transistor 46 which has an output at junction 47 to which one side of all of the relays K1, K2, K3, and K4 are connected. A diode 48 is shown that protects transistor 46. Four free wheeling diodes for the relays are contained within buffer 51. The common connection 47 not only supplies power to all of the relays K1, K2, K3, and K4, but also supplies an indication of the power on conductor 50 to a buffer generally disclosed at 51. The buffer 51 is also connected by conductors 52, 53, 54, and 55 to the relays to provide the necessary logic control function for the operation of the condition control system 10. The logic control signals are supplied through the buffer 51 from circuitry that will be described subsequently.

The buffer 51 also supplies a control signal on conductor 56 to a safety circuit 57 that in turn controls the voltage on conductor 58 to switch the transistor 46 to apply a potential from the voltage source 45 to the junction 47 under the control of the safety circuit 57. The safety circuit 57 has a further output 60 which is connected back to the buffer 51. The details of the safety circuit 57 are not material to the present invention. To this point the essential elements of operation are that the various conductors 52, 53, 54, and 55 are used to supply a ground for each of the relays K1, K2, K3, and K4 through the buffer 51 and will control the relays depending on the availability of voltage at junction 47 which in turn is dependent on whether the solid state switch means or transistor 46 is conducting or is not conducting.

The condition control system 10 utilizes a control logic means generally disclosed at 62. The control logic means 62 typically would be a minicomputer or microprocessor type of device that is capable of handling a large number of input and output signals in accordance with logic that is stored within the device. The particular type of control logic means 62 is not material to the present invention and the control logic means 62 could be a hard wired piece of equipment or could be a typical microprocessor utilizing conventional microprocessor technology. The control logic means 62 has a number of inputs and outputs. The inputs to the control logic means 62 are on conductors 63, 64, 65, 66, 67, and 68. The inputs 63 and 64 are through the buffer 51 and represent the signals on conductors 50 and 60. The input 68 is from a flame amplifier 70 that is connected to the terminals 37 and 38 and is responsive to the flame sensor 36. The flame amplifier 70 is of convention design and the output on conductor 68 is representative of either the presence or absence of a flame at the flame sensor 36 in the fuel burner means 11. The last disclosed inputs to the control logic means 62 are inputs 65, 66, and 67. These inputs are supplied through a buffer 71 from devices which will be described after the outputs from the control logic means 62 are described. The output signals from the control logic means 62 are provided on the conductors 72, 73, 74, 75, and 76. The outputs from the control logic means 62 on conductors 72, 73, 74, and 75 are fed through the buffer 51 to the conductors 52, 53, 54, and 55 to control the four relays. The output signal on conductor 76 is fed through the buffer 51 to the conductor 56 which ultimately controls the "on" and "off" states of the solid state switch means 46 to apply the voltage or to remove the voltage from the junction 47.

Figure 2:
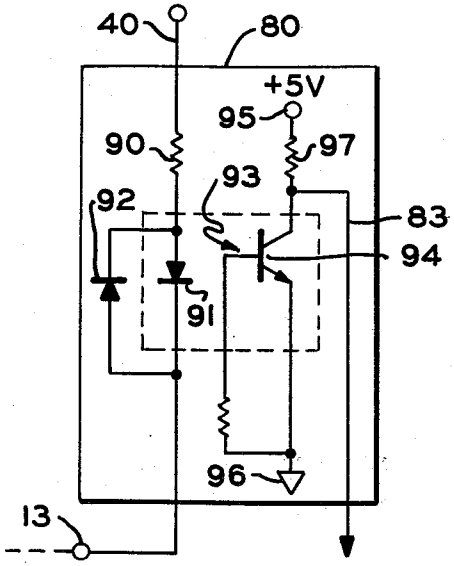
FIG. 2 is a drawing of an opto-isolator type of isolated signal transmission means.
Figure 3:
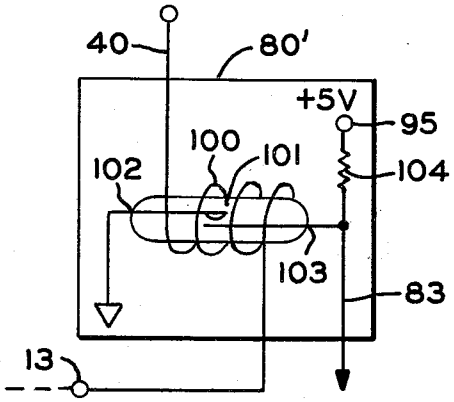
FIG. 3 is a schematic representation of a reed relay type of isolated signal transmission means.

The condition control system is complete by the provision of three isolated signal transmission means 80, 81, and 82. The isolated signal transmission means typically would be opto-isolators but could be any type of device which is capable of electrically isolating the input and output of the isolated signal transmission means while transmitting the signal therethrough. A further type of isolated signal transmission means might be a device such as a reed relay . In FIGS. 2 and 3 typical opto-isolators and reed relay configurations that would be applicable to the block disclosures of the isolated signal transmission means have been provided and will be described in more detail after the description of the condition control system 10.

The isolated signal transmission means 80 is connected to have an input on conductor 40 and an output on conductor 83. The isolated signal transmission means 81 is connected by a conductor 84 to the terminal 27 which forms the output side of the relay contacts K1-1 and K4-1. The isolated signal transmission means 81 has a further output conductor 85. The last isolated signal transmission means 82 has an input conductor 86 which is connected to the terminal 33 which in turn is the output side of the contacts K3-2, K2-2, and K4-2. The isolated signal transmission means 82 has an output conductor 87. The output conductors 83, 85, and 87 feed into the buffer 71 and provide the input signals on conductors 65, 66, and 67 to the control logic means 62. The overall circuit of the present device is completed by a conductor 88 which joins the terminals 20 and 25 to supply power to the fan motor 24.

Before the operation of the device is provided, a brief description of the isolated signal transmission means 80, 81 or 82 will be disclosed in connection with FIGS. 2 and 3.

In FIG. 2 one form of isolated signal transmission means 80 is disclosed having an input conductor 40 and a conductor to terminal 13 which are connected in series with a resistor 90 and a light emitting diode 91. The light emitting diode 91 is paralleled in a reverse fashion by a further diode 92 so that the back-to-back configuration of the diodes 91 and 92 form a bidirectional current conducting path. Whenever this path is energized, the light emitting diode 91 emits a light disclosed at 93 to a phototransistor 94 that has an input connected to a voltage source 95 and is further connected at its emitter to ground 96. The source 95 is connected through resistor 97 to the conductor previously disclosed as 83. The isolated signal transmission means specifically disclosed in FIG. 2 is a conventional opto-isolator of a conventional type and has been disclosed as one way in which the isolated signal transmission means disclosed as 80, 81, or 82 could be carried out.

In FIG. 3 there is a further version of the isolated signal transmission means disclosed as a reed relay. The isolated signal transmission means in FIG. 3 has been disclosed as 80' and has the input conductor 40 and a conductor connected to terminal 13 by a magnetic coil 100 which encircles a reed relay of conventional design at 101. The reed relay has a pair of output conductors 102 and 103 with the conductor 102 grounded within the isolated signal transmission 80'. The output conductor 103 is connected through a resistor 104 to the voltage source 95 while also being connected to the conductor 83. It will be noted that the operation of the reed relay 101 in response to the potential between the conductors 40 and terminal 13 will cause the relay to close thereby changing the voltage on conductor 83 in a manner which would appear the same as the signal generated by the isolated transmission means 80 disclosed in FIG. 2.

OPERATION OF FIG. 1

With alternating current applied to the conductors 14 and 15 there is simultaneously supplied the necessary power to the standby operating portions of the control system means 10. This means that the typical voltage for the terminal 45 would be at a positive 24 volts and the necessary voltage (5 volts) would be available to operate the control logic means 62. The 5 volt terminals 95 in the isolated signal transmission means 80, 81, and 82 along with any other necessary operating voltage other than the voltage controlled by the relay contacts for relays K1, K2, K3, and K4 is present.

With the line voltage applied between the conductors 14 and 15 and the limit control means 16 closed in its normal standby condition indicating that the various fuel pressures and other safety equipment are properly positioned, the overall system will remain in standby as long as controller or thermostat 17 remains open. With these conditions existing the relays K3 and K4 are in an energized state by the control logic means 62, while the relays K1 and K2 are deenergized. The status of the relays can be determined by reference to FIG. 4. Since the relay K3 is energized the normally closed contact K3-1 is open and there is no alarm signal.

Upon a call for heat the controller or thermostat 17 closes applying a line voltage to the conductor 40. The application of voltage to conductor 40 immediately causes the isolated signal transmission means 80 to indicate to the control logic means 62 via the conductor 83 and the buffer 71 that a voltage appeared, as it should. The control logic means 62 therefore can verify the existence of the application of voltage and the voltage is immediately fed through the contact K3-2 which is closed due to the operation of the relay K3 to energize the damper motor 34 driving the motor to a high fire position. The operation of the motor in the high fire position along with the immediate energization of the fan motor 24 via the conductor 88 causes a prepurge period to exist for the burner. Early in the prepurge portion of the cycle (a cycle which is timed by an internal clock of the control logic means 62) the relay contacts K1-1, K2-2, K4-2, and K4-1 are checked for their proper status by the control logic means 62 comparing its internal program to the inputs on the conductors 83, 85 and 87 to the buffer 71 where the information is fed on conductor 65, 66, and 67 to the control logic means 62. After this checking period K1, K2, and K3 remain energized.

After the time interval for the high fire operation of the damper, the control logic means 62 (again by its internal clock means) causes the relay K3 to be deenergized thereby opening the contact K3-2. The status of contact K3-2 is checked at this time. This deenergizes the damper motor and allows the high fire operation to transfer to low fire in preparation of light off of the burner. After a short interval, the control logic means 62 deenergizes the relay K2 to apply voltage through the contact K2-1 to the terminal 31 and the ignition source 30 for the burner. After a further short interval the control logic means 62 causes the relay K4 to be energized thereby completing a circuit through the relay contacts K1-1 and K4-1 to the terminal 27 to energize the pilot valve source 26. At this time a voltage is applied through the conductor 84 to the isolated signal transmission means 81 thereby advising the control logic means 62 that the called for function has in fact occurred.

With the ignition and the pilot valve energized, the burner normally comes into operation and the flame sensor 36 supplies that information via the terminals 37 and 38 and the flame amplifier 70 to the control logic means 62. In the event that a proper flame signal is not sensed, the control logic means 62 is capable of then shutting down the entire device in a safety lock out condition.

Assuming that the flame sensor 36 senses the flame the control logic means 62 continues the time sequencing of the device until it is time to energize the main valve 32. At this time the relays K2, K3, and K4 are all energized completing a series circuit through the contacts K3-2, K2-2, and K4-2. The completion of this circuit is verified by voltage appearing on conductor 86 to the isolated signal transmission means 82 where the information is fed back to the control logic means 62 thereby verifying the safe operation of the device. The control system or burner control system 10 remains in an energized state as long as the controller or thermostat 17 remains closed and as long as there is no fault in the system. Upon the opening of the thermostat 17 removing the voltage from the system, the control logic means 62 is programmed to return to a condition where the relays K3 and K4 are energized with the relays K1 and K2 deenergized in preparation for the next cycle of operation.

Figure 4:
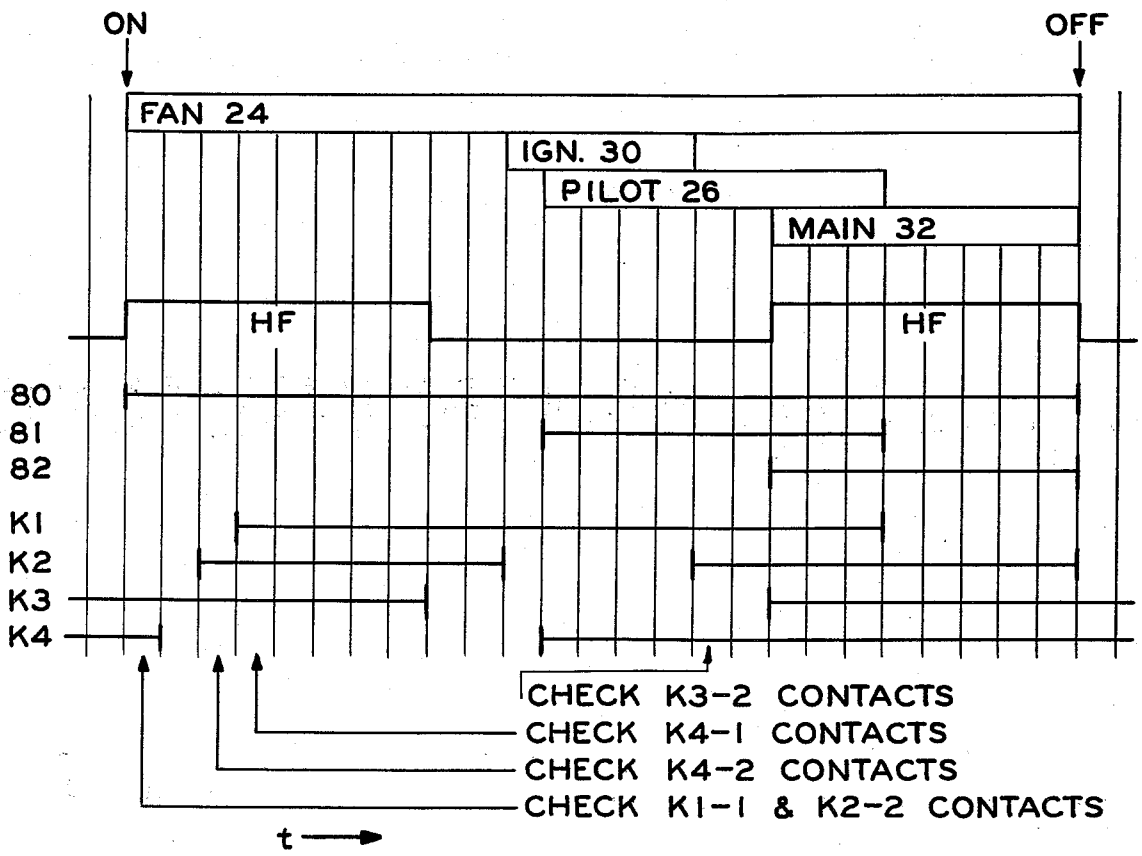
FIG. 4 is a bar chart disclosing the operating characteristics of the system.

In FIG. 4 there is a typical bar chart of a burner control system 10 in which the status of the operation of the burner control system is blocked out at the top with the "on" and "off" points for a typical burner cycle. The top bar indicates the operation of the fan 24 while the next bar indicates the ignition cycle for the ignition source 30. The next bar indicates the operation of the pilot valve 26 and the fourth bar indicates the period of time which the main valve 32 is energized. Immediately below this, the high fire (HF) operation of the device as controlled by the damper motor is disclosed.

Under the bar chart of the burner control system 10 are three lines indicating the active times for the three isolated signal transmission means 80, 81 and 82. The solid lines indicate the period of time in which the output of the isolated signal transmission means 80, 81, and 82 are in a "1" state, as opposed to a "0" state.

Immediately beneath the charting of the "1" and "0" states for the isolated signal transmission means, the status of the four relays K1, K2, K3, and K4 is shown. By consulting any point in the reference time across the bar chart it is possible to determine the proper state for the isolated signal transmission means and the relays. The content of the bar chart and related material reflects the internal logic contained in the control logic means 62. Four check points have been indicated at the bottom of the bar chart to indicate at what points the various relay contacts have been verified. The particular point at which they have been verified can be varied depending on the content of the circuitry in the control logic means 62 and the check points disclosed are typical. It will be noted that all of the relays have been checked for their safe status during the prepurge portion of the cycle prior to the initiation of the ignition and opening of the pilot valve. This allows for checking all of the contacts prior to any critical point in operation.

The applicants have disclosed one preferred embodiment of the present invention but it is quite obvious that with the state of the art and the many varied control configurations that are possible in devices such as the control logic means 62, that the exact means of carrying out the present invention can be accomplished in many different ways. The applicants wish to be limited in the scope of their invention solely by the scope of the appended claims.

The embodiments of the invention in which an exclusive property or right is claimed are defined as follows:

1. A condition control system having a plurality of output relays adapted to control load means with said load means including at least one critical load and wherein said output relays are monitored to insure the safe operation of said load means, including; control logic means having a plurality of output relays with said control logic means adapted to operate said load means in response to condition responsive means; said output relays each having at least one pair of relay contacts; said output relay contacts connected wherein a pair of contacts from at least two relays electrically are connected in a series energizing circuit to said critical load to insure that electrical failure of one of said pairs of contacts will not preclude the deenergization of said critical load upon said relays being operated by said control logic means to open said series circuit; isolated signal transmission means connected to said relay contacts to supply signals to said control logic means as to the state of said relay contacts; and solid state switch means controlled by said control logic means and connected to all of said relays to operably control power to all of said relays; said solid state switch means responding to said control logic means to remove power from all of said control logic means to remove power from all of said relays when said control logic means discerns a relay contact failure in response to signals from said isolated signal transmission means.

2. A condition control system as described in claim 1 wherein said load means includes a fuel burner and said critical load is fuel supply means for said fuel burner.

3. A condition control system as described in claim 2 wherein said control logic means includes a microcomputer which is connected and arranged to operate said output relays to program said fuel burner to safely burn fuel provided by said fuel supply means.

4. A condition control system as described in claim 3 wherein said isolated signal transmission means includes opto-isolator means which electrically isolates said output relay contacts from said control logic means.

5. A condition control system as described in claim 3 wherein said isolated signal transmission means includes reed relay means which electrically isolate said output relay contacts from said control logic means.

6. A condition control system as described in claim 4 wherein said solid state switch means is a transistor controlled by an output of said microcomputer; and wherein said microcomputer has an input connected to said transistor to sense the state of conduction of said transistor.

7. A condition control system as described in claim 4 wherein said opto-isolator means includes individual opto-isolators connected to an input side and an output side of said series energizing circuit for said critical load means.

8. A condition control system as described in claim 2 wherein said condition control system is a fuel burner control system with flame sensor means responsive to the presence or absence of flame in said fuel burner; and said flame sensor means is connected to said control logic means to provide said control logic means with an indication of the presence or absence of flame in said burner to thereby allow said control logic means to safely operate said load means.

9. A condition control system as described in claim 8 wherein said fuel burner control system further includes a controllable source of burner air, ignition means, and pilot fuel means; said control logic means sequencing said burner air, said ignition means, said pilot fuel means, and said critical load means to provide safe operation of said fuel burner; said flame sensor means and said isolated signal transmission means connected to and supplying said control logic means with status signals to allow said control logic means to admit fuel and operate said burner only when safe operating conditions are met.

10. A condition control system having a plurality of output relays adapted to control load means wherein said output relays are monitored to insure the safe operation of said load means, including; control logic means having a plurality of output relays with said control logic means adapted to operate said load means in response to condition responsive means by selectively operating said relays in a predetermined sequence; said output relays each having at least one pair of relay contacts; said output relay contacts selectively connecting said load means to a source of power upon said relays being operated by said control logic means to operably energize said load means; isolated signal transmission means connected to said relay contacts to supply signals to said control logic means as to the state of said relay contacts; said control logic means selectively operating said plurality of output relays and responding to said isolated signal transmission means; and solid state switch means controlled by said control logic means and connected to all of said relays to operably control power to all of said relays; said solid state switch means responding to said control logic means to remove power from all of said relays when said control logic means discerns a relay contact failure in response to signals from said isolated signal transmission means.

11. A condition control system as described in claim 10 wherein said load means includes a fuel burner having fuel supply means for said fuel burner.

12. A condition control system as described in claim 11 wherein said control logic means includes a microcomputer which is connected and arranged to operate said output relays to program said fuel burner to safely burn fuel provided by said fuel supply means.

13. A condition control system as described in claim 12 wherein said isolated signal transmission means includes opto-isolator means which electrically isolates said output relay contacts from said control logic means.

14. A condition control system as described in claim 12 wherein said isolated signal transmission means includes reed relay means which electrically isolate said output relay contacts from said control logic means.

15. A condition control system as described in claim 13 wherein said solid state switch means is a transistor controlled by an output of said microcomputer; and wherein said microcomputer has an input connected to said transistor to sense the state of conduction of said transistor.

16. A condition control system as described in claim 12 wherein said opto-isolator means includes individual opto-isolators connected to an input side and an output side of a circuit for control of said fuel supply means.

17. A condition control system as described in claim 11 wherein said condition control system is a fuel burner control system with flame sensor means responsive to the presence or absence of flame in said fuel burner; and said flame sensor means is connected to said control logic means to provide said control logic means with an indication of the presence or absence of flame in said burner to thereby allow said control logic means to safely operate said load means.

18. A condition control system as described in claim 17 wherein said fuel burner control system further includes a controllable source of burner air, ignition means, and said fuel supply means includes pilot fuel means; said control logic means sequencing said burner air, said ignition means, and said fuel supply means to provide safe operation of said fuel burner; said flame sensor means and said isolated signal transmission means connected to and supplying said control logic means with status signals to allow said control logic means to admit fuel and operate said burner only when safe operating conditions are met.

* * * * *